United States Patent [19]

Jeschke

[11] 4,311,095

[45] Jan. 19, 1982

[54] CLEANING DEVICE FOR PRINTING-UNIT CYLINDERS IN OFFSET PRINTING MACHINES

[75] Inventor: Willi Jeschke, Heidelberg, Fed. Rep. of Germany

[73] Assignee: Heidelberger Druckmaschinen AG, Heidelberg, Fed. Rep. of Germany

[21] Appl. No.: 48,898

[22] Filed: Jun. 15, 1979

Related U.S. Application Data

[63] Continuation of Ser. No. 897,844, Apr. 19, 1978, abandoned, which is a continuation of Ser. No. 706,064, Jul. 16, 1976, abandoned.

[30] Foreign Application Priority Data

Jul. 17, 1975 [DE] Fed. Rep. of Germany ..... 2531886

[51] Int. Cl.[3] ..... B41F 35/00

[52] U.S. Cl. ..... 101/426; 101/425; 101/247; 101/148

[58] Field of Search ..... 101/425, 147, 148, 142, 101/247

[56] References Cited

U.S. PATENT DOCUMENTS

| | | | |
|---|---|---|---|
| 2,970,541 | 2/1961 | Gegenheimer | 101/425 |
| 3,153,380 | 10/1976 | Gericke | 101/425 |
| 3,983,813 | 10/1976 | Tani | 101/425 |

*Primary Examiner*—William Pieprz
*Attorney, Agent, or Firm*—Herbert L. Lerner

[57] ABSTRACT

An offset printing machine having a cleaning device for a printing-unit cylinder with plate, blanket and impression cylinders, includes a washing device engaging with the blanket cylinder in operating position thereof, and means for engaging the blanket cylinder with at least the impression cylinder in operating position of the washing device.

3 Claims, 3 Drawing Figures

CLEANING DEVICE FOR PRINTING-UNIT CYLINDERS IN OFFSET PRINTING MACHINES

This is a continuation of application Ser. No. 897,844, filed April 19, 1978, which is a continuation application of Ser. No. 706,064, filed July 16, 1976, both prior applications being now abandoned.

The invention relates to a cleaning device for printing unit cylinders in offset printing machines having plate, blanket, and impression cylinders as well as a washing device engageable into operating position thereof with the blanket cylinder.

Washing devices have been known heretofore for cleaning the cylinder covered with a rubber blanket, and are engaged with the blanket cylinder while the latter is disengaged from the plate and impression cylinders. The washing operation is thus effected with the engagement pressure removed. After the rubber blanket surface has been cleaned, the blanket cylinder is brought into engagement with the plate and impression cylinders again, and the printing process can be started immediately. A washing device of this general type is shown for example in German Published Non-prosecuted Application DT-OS No. 1 761 111.

In addition, washing devices for blanket cylinders of web-fed printing machines, which are used during operation of the printing machine, are known from German Patent DP-PS No. 1 561 008. In this case, the blanket cylinders serve simultaneously as impression cylinders. The cleaning roller of the washing devices, which rotate in opposite direction from that of the blanket cylinder, remove particles of dirt from the surface of the blanket cylinders, while the traveling paper web carries off excess washing liquid.

The aim of the invention is to clean the impression cylinder. The aforementioned washing devices are unable to do this, because either the impression cylinder is disengaged during the cleaning operation or the paper web is employed to remove excess washing liquid so that no engagement can be effected between the blanket cylinder and the impression cylinder.

In sheet-fed offset printing machines, various sizes or formats of sheets are usually printed. In the printing of sheets of smaller format, the surface of the impression cylinder beyond the sheet frequently become dirty. When the sheet-fed offset printing machine is changed over to a larger size or format of the sheet, the impression cylinder must be cleaned before the start of the printing operation.

The impression cylinder must be cleaned even more frequently in multi-color recto-printing machines which are changeable over to perfecting, than in the case of the previously mentioned sheet-fed rotary printing machines. As is well known, when such machines are set for perfecting, the sheet is turned between the first and second printing units. Consequently, the turned sheet, which has been printed on one side thereof, is supported during printing in the second printing unit by the damp, printed recto side thereof on the impression cylinder. Consequently, ink deposited by the freshly printed sheet surfaces necessarily accumulates on the surface of the impression cylinder. In order to keep this build-up of ink as small as possible, the peripheral surface of the impression cylinder is provided either with a covering or with a special surface. Despite these measures, it is necessary to clean the peripheral surface of the impression cylinder at given intervals of time, because even with the most advantageous kind of surface it is not possible for the build-up of ink to be completely prevented. After reaching a saturation point, the accumulating ink is finally taken up by the sheets passing through, so that these printed sheets are then useless. Consequently, high quality printing on perfecting machines is possible only if the impression cylinder, which follows the sheet-turning drum, is also cleaned regularly.

It is accordingly an object of the invention to provide a cleaning device for printing-unit cylinders in offset printing machines wherein the impression cylinder is cleaned without any additional washing device i.e. by simple means, automatically, rapidly and reliably.

With the foregoing and other objects in view, there is provided, in accordance with the invention, in an offset printing machine, a cleaning device for printing-unit cylinders including plate, blanket and impression cylinders comprising a washing device engaging with the blanket cylinder in operating position thereof, and means for engaging the blanket cylinder with at least the impression cylinder in operating position of the washing device.

It has surprisingly been found that the impression cylinder can be rapidly and reliably cleaned by known washing devices with the aid of the blanket cylinder. Manual washing of the impression cylinder, which had to be carried out heretofore by the operator when changing over from a smaller to a larger sheet format or in perfecting machines, is eliminated. A separate washing machine for the automatic washing of the impression cylinder and also the space required therefor can thus be spared.

In accordance with another feature of the invention, wherein the printing machine also includes dampening and inking rollers engageable with the plate cylinder, means are provided for engaging the blanket cylinder simultaneously with both the impression and the plate cylinders while the dampening and inking rollers are disengaged from the plate cylinder.

The so-called engagement or contact pressure of all three printing unit cylinders can thereby be used in a simple manner for washing the impression cylinder. The switch device is thus of especially simple construction. Care must be taken, of course, that no washing medium which attacks the offset plate is used.

Other features which are considered as characteristic for the invention are set forth in the appended claims.

Although the invention is illustrated and described herein as embodied in cleaning device for printing-unit cylinders in offset printing machines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
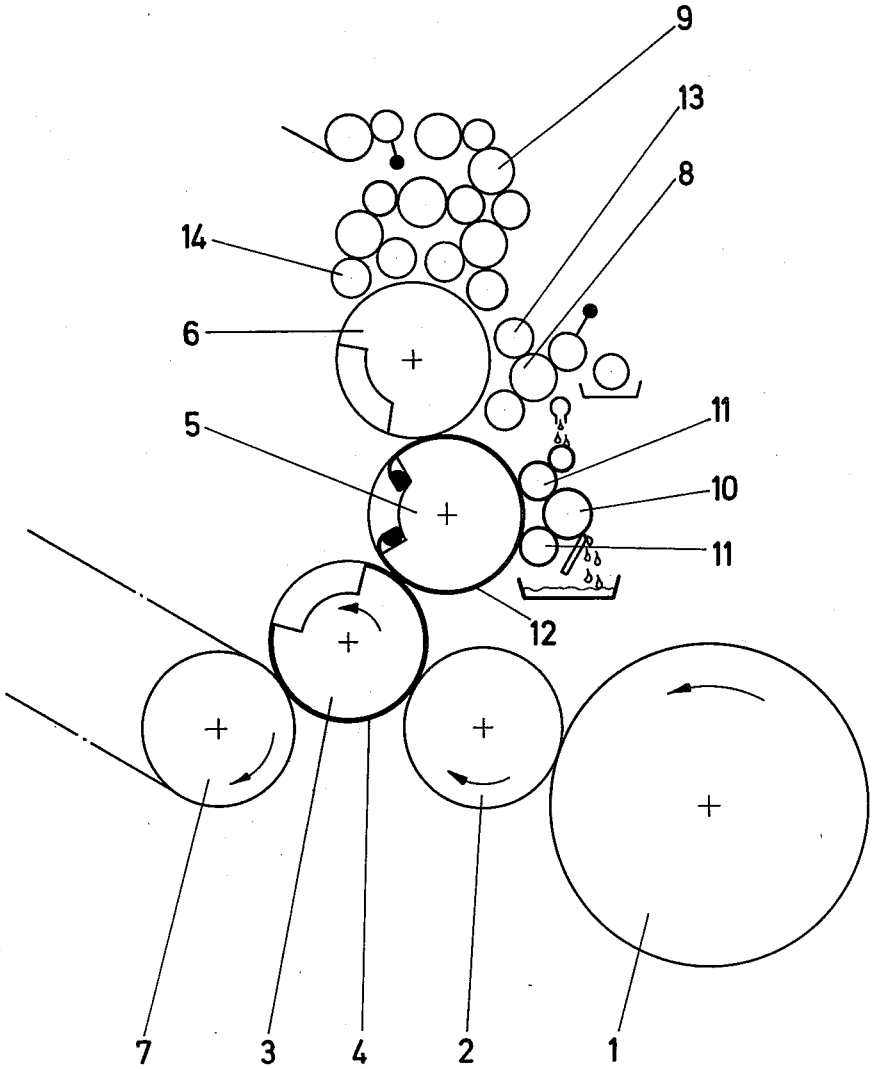
FIG. 1 is a diagrammatic view of an offset printing unit with the printing unit cylinders in contact and with a washing device applied against the blanket cylinder.

Referring now to the drawing and first, particularly, to FIG. 1 thereof, there is shown the second printing unit of a two-color offset printing machine which can be changed over from single-side printing to double-side perfecting. A transfer drum 1 having double the diameter of the other cylinders of the printing unit transfers a sheet, which has been printed on one side, to a sheet turning or turn-over drum or cylinder 2, which carries the turned sheet to an impression cylinder 3. On this impression cylinder 3, the sheet comes to lie with the printed side thereof on the surface of the cylinder casing. In order to prevent set-off on the surface of the impression cylinder 3 when the other side of the sheet is subsequently printed, the impression cylinder 3 is covered by a metal foil 4 of conventional specialized construction. A blanket cylinder 5, which receives the printed image from a plate cylinder 6, prints the unprinted side of the sheet. When printing has been completed, the impression cylinder 3 transfers the sheet that has thus been printed on both sides to a chain delivery system 7.

As is customary in offset printing machines, a dampening unit 8 and inking unit 9 are provided, the rollers 13 and 14 of which are engageable with the plate cylinder 6. Furthermore, a washing device 10 is also provided, which can be applied to or engaged with the blanket cylinder 5.

In the control position shown in FIG. 1, the blanket cylinder 5 is applied against or engages both the impression cylinder 3 and the plate cylinder 6, while the dampening rollers 13 of the dampening unit 8 and the inking rollers 14 of the inking unit 9 are lifted away from the plate cylinder 6. The washing device 10 on the other hand is applied against or engages the blanket cylinder 5 and is thus in operative position. Washing liquid is delivered in metered quantities to the surface of the blanket cylinder 5, thereby effecting an initial cleaning of the rubber blanket 12 and then also of the impression cylinder 3. After the washing solution has been applied, two washing rollers 11 of the washing device 10 first remove the softened dirt from the rubber blanket 12 of the blanket cylinder 5, and then also the particles of dirt and ink residues from the impression cylinder 3. After cleaning the rubber blanket 12 and the metal foil 4 which is stretched over the impression cylinder 3, in a collateral or incidental action, the printing plate mounted on the plate cylinder 6 is also cleaned each time.

Figure 2:
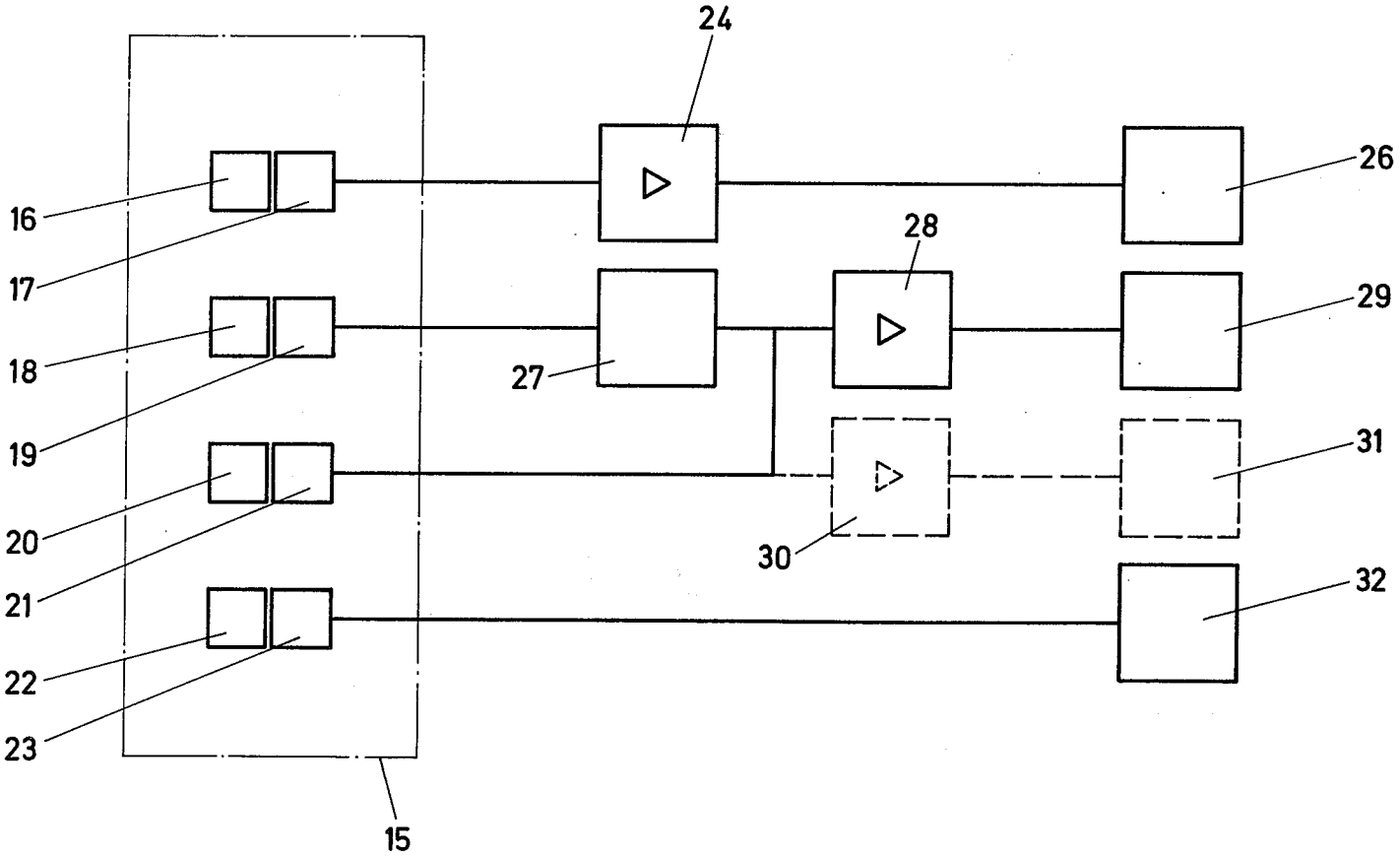
FIG. 2 is a block circuit diagram showing control elements for switching over the printing unit shown in FIG. 1 for the purpose of cleaning the impression cylinder.

The switch or control members for initiating the cleaning of the impression cylinder 3 are shown in FIG. 2. On a control desk 15, shown in phantom, four pairs of push-button switches 16, 17, 18, 19, 20, 21, and 22, 23 are shown. The push button switches 16 and 17 serve to switch the printing machine on and off. They actuate a main motor 26 of the printing machine with the aid of a conventional amplifier 24.

By means of the pair of push-button switches 18, 19, movement of the paper is started and the pressure application to the respective printing unit cylinders preselected and both of these control operations can be canceled or discontinued. If an electronic interrogating device 27 of any conventional type preceding each printing unit detects the arrival of a sheet, it transmits a switch pulse by conventional means which, after amplification by the amplifier 28, acts upon a conventional alternating-current magnet 29 to exert a suitable force upon the blanket cylinder 5 so that the latter engages under pressure the impression cylinder 3 and plate cylinder 6 as shown in FIG. 1.

By means of the pair of push-button switches 20 and 21, the blanket cylinder 5 can similarly be applied against and disengaged from the neighboring cylinders 3 and 6 with the aid of the amplifier 28 and the alternating-current magnet 29. Furthermore, through actuation of the push-button switches 20 and 21, the dampening rollers 13 of the dampening unit 8 and the inking rollers 14 of the inking unit 9 are applied against or moved away from the plate cylinder 6 with the aid of the amplifier 30 shown in broken lines in FIG. 2 and of the alternating current magnet 31 likewise shown in broken lines in FIG. 2. The rollers 13 and 14 can, however, also be moved into and out of contact by hand.

Finally, with the aid of the pair of push-button switches 22, 23 through the switch means 32, such as alternating current magnets, for example, the washing device 10 can be swung into operative position and set into operation, or swung back to the rest or neutral position thereof and rendered inoperative. The washing device 10 can, naturally, also be set into operation manually.

The mode of operation of the hereaforedescribed device of the invention is as follows:

If, after a predetermined number of sheets have been printed, the metal foil 4 of the impression cylinder 3 is to be cleaned, the movement of the paper web is first interrupted by means of the preselector push-button switch 19, whereupon, due to the absence of any oncoming sheets, the electronic interrogation device 27 disengages the blanket cylinder 5 from the impression cylinder 3 and the plate cylinder 6 with the aid of the amplifier 28 and the alternating-current magnet 29. Due to the actuation of the push-button switch 16, the main motor 26 is then switched through the amplifier 24 to a given speed. Thereafter, the push-button switch 22 is to be depressed, whereby the washing device 10 is placed into operative position against the rotating blanket cylinder 12 and set into operation i.e. washing solution is fed in metered amounts by means of the washing rollers 11 to the rubber blanket 12.

After the rubber blanket 12 of the blanket cylinder 5 has been washed for several revolutions, the push-button 20 is depressed, whereupon, by means of the amplifier 28 and the alternating-current magnet 29, the blanket cylinder 5 is applied against or brought into engagement with the impression cylinder 3 and the plate cylinder 6. The washing device 10 accordingly follows the movement of the blanket cylinder 5 i.e. the washing rollers 11 remain in engagement with the rubber blanket 12. Due to the actuation of the push-button 20, and with the aid of the amplifier 30 and alternating current 30, the rollers 13, 14 are disengaged from the plate cylinder 6. If the switch means 30, 31, shown in broken lines in FIG. 2, are dispensed with, the rollers 13, 14 must be disengaged manually before actuating the push-button 20.

After a short time period, the set-off foil 4 of the impression cylinder 3 is cleaned by the cleaned rubber blanket 12. Through actuation of the push-button switch 23, the washing device 10 is swung by the switch means 32 to the rest or neutral position, the washing rollers 11 being thereby released from the rubber blanket 12 and the washing device per se being inactivated.

By applying pressure to the push-button switch 23, the cleaned rubber cylinder 5 is lifted away from both the impression cylinder 3 and the plate cylinder 6, which have been cleaned similarly, and the dampening rollers 13 of the dampening unit 8 as well as the inking rollers 14 of the inking unit 9 are released for subsequent application against or engagement with the plate cylinder 6. Through actuation of the push-button 19, the paper feed is set in operation and the engagement position of the blanket cylinder 5 is preselected. When the first sheet reaches the electronic interrogation device 27, the engagement positioning of the blanket cylinder 5 occurs and the printing process begins anew.

In a modification of the circuit arrangement shown in FIG. 2, the amplifier 30 and the alternating-current magnet 31 are dispensed with when it is preferred to disengage the rollers 13 and 14 and re-engage them after the washing process manually before actuating the push-button switch 20 for the purpose of applying the blanket cylinder 5 against or bringing it into engagement with the impression cylinder 3 and the plate cylinder 6. Instead of being actuated by the switch means 22, 23 and 32, the washing device may also be actuated manually.

Figure 3:
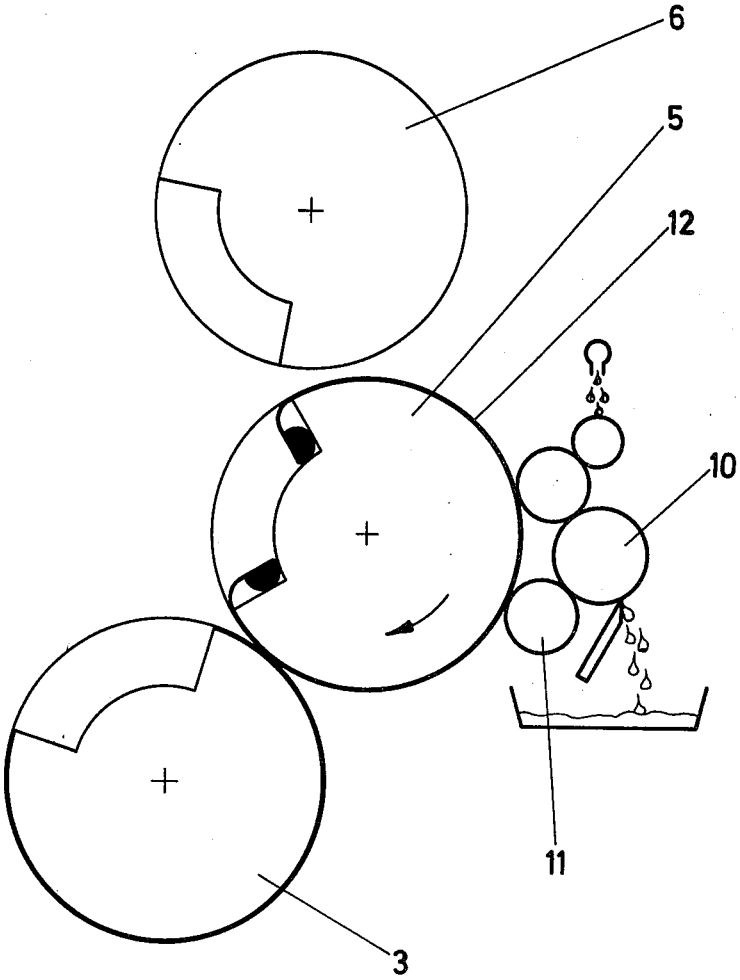
FIG. 3 is an enlarged fragmentary view of FIG. 1 showing the printing unit in another mode thereof wherein the washing device is in operative position and the blanket cylinder is applied only against the impression cylinder.

The printing unit arrangement shown in FIG. 3 is applicable to a printing unit of any offset printing machine which, exactly as in FIG. 1, has a blanket cylinder 5, an impression cylinder 3, and a plate cylinder 6. In the interest of clarity, the dampening and inking units have been omitted in FIG. 3. The washing device 10 together with the washing roller 11 has been shifted to operative position, i.e. the washing rollers 11 lie in engagement with the rubber blanket 12.

In contrast to the embodiment shown in FIG. 1, the blanket cylinder 5 of the embodiment of FIG. 3 is applied against or in engagement only with the impression cylinder 3. This has the advantage that when selecting the washing medium, it is unnecessary to take into account the sensitive printing plate while, in addition, the cleaning of the impression cylinder is effected even more rapidly than when the plate cylinder 6 lies against or engages the blanket cylinder 5. Indeed, in this embodiment of the invention, it is not possible to utilize the normal engagement or contact pressure of the blanket cylinder 5. On the contrary, a separate switch arrangement is necessary in order to bring the blanket cylinder 5 into engagement exclusively with the impression cylinder 3. For the purpose of cleaning the impression cylinder 3, in this embodiment of FIG. 3, it is advantageous also for the blanket cylinder 5 first to be washed before being applied against or brought into engagement with the impression cylinder 3.

There are claimed:

1. Method of cleaning cylinders of an offset printing unit having plate, blanket and impression cylinders and a washing device engageable, in operating position thereof, with the blanket cylinder after discontinuance of printing by the printing unit, the printing unit being operated without paper feed and with the blanket cylinder rotating while disengaged from the impression cylinder and the plate cylinder, which comprises applying washing liquid with the washing device to the rotating blanket cylinder while the blanket cylinder is disengaged from the impression cylinder and the plate cylinder so as to clean the blanket cylinder to remove most or substantially all foreign material accumulated thereon, engaging the blanket cylinder with at least one of the plate and impression cylinders, and continuing to apply washing liquid with the washing device to the blanket cylinder so as to clean the blanket cylinder and the at least one of the plate and impression cylinders engaged therewith.

2. Method according to claim 1 wherein the offset printing unit also includes dampening and inking rollers engaged with the plate cylinder during printing by the printing unit, and which comprises engaging the blanket cylinder not only with one of the plate and the impression cylinders but also simultaneously with the other of the plate and the impression cylinders, and additionally disengaging the dampening and inking rollers from the plate cylinder during the continuing application of washing liquid to the blanket cylinder.

3. Device for cleaning cylinders of an offset printing unit having plate, blanket and impression cylinders, the printing unit being operated without paper feed and with the blanket cylinder rotating while disengaged from the impression cylinder and the plate cylinder, comprising a washing device, means for engaging said washing device, in operating position thereof, with the blanket cylinder after discontinuance of printing by the printing unit for applying washing liquid to the rotating blanket cylinder while the blanket cylinder is disengaged from the impression cylinder and the plate cylinder so as to clean the blanket cylinder to remove most or substantially all foreign material accumulated thereon, and means for engaging the blanket cylinder with at least one of the plate and impression cylinders, said means for engaging said washing device with the blanket cylinder maintaining engagement of said washing device with the blanket cylinder during engagement of the blanket with said at least one of the plate and impression cylinders so as to continue to apply washing liquid to the blanket cylinder for cleaning the blanket cylinder and the at least one of the plate and impression cylinders engaged therewith.

* * * * *